US006305900B1

(12) United States Patent
Yu

(10) Patent No.: US 6,305,900 B1
(45) Date of Patent: Oct. 23, 2001

(54) NON-CORROSIVE REGENERATIVE FUEL PUMP HOUSING WITH DOUBLE SEAL DESIGN

(75) Inventor: DeQuan Yu, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/482,655

(22) Filed: Jan. 13, 2000

(51) Int. Cl.[7] ..... F01D 1/12
(52) U.S. Cl. ..... 415/55.1
(58) Field of Search ..... 415/55.1, 55.2, 415/55.3, 55.4

(56) References Cited

U.S. PATENT DOCUMENTS 4,586,877 5/1986 Watanabe et al. .
4,872,806 10/1989 Yamada et al. .
4,915,582 4/1990 Nishikawa .
5,123,809 6/1992 Ito .
5,375,970 12/1994 Iwai et al. .
5,549,446 8/1996 Gaston et al. .
5,762,469 6/1998 Yu .
5,921,746 7/1999 Yu et al. .

*Primary Examiner*—John Kwon
(74) *Attorney, Agent, or Firm*—John E. Kajander

(57) ABSTRACT

A non-corrosive fuel pump housing (36) that can be used in high-pressure applications and with aggressive or flex fuels. The fuel pump housing (36) is comprised of a pump cover (40) and pump body (38). The pump cover (40) and pump body (38) each have a narrow seal ring (101, 104), a cavity circle (103, 106), and a tapered seal ring (102, 105) extending radially from the narrow seal ring (101, 104) to the cavity circle (103, 106) that reduce friction between the impeller (34) and pump housing (36) and limit leakage between the impeller (34) and the pump housing (36). The pump housing (36) is composed of a thermosetting or thermoplastic material; as such material and manufacturing costs are less than traditional anodized aluminum pump housings.

17 Claims, 2 Drawing Sheets

NON-CORROSIVE REGENERATIVE FUEL PUMP HOUSING WITH DOUBLE SEAL DESIGN

TECHNICAL FIELD

The present invention relates to vehicle fuel pumps and more particularly to a non-corrosive regenerative fuel pump housing for use in an automobile.

BACKGROUND

Conventional tank-mounted automotive fuel pumps typically have a rotary-pumping element, such as an impeller with a plurality of grooves encased within a pump housing. Rotation of the impeller draws fuel into a pumping chamber within the pump housing. The rotary pumping action of the vanes and the vane grooves of the impeller causes the fuel to exit the housing at high-pressure. Regenerative turbine fuel pumps are commonly used to pump fuel in automotive engines because they have a more constant discharge pressure than, for example, positive displacement pumps. In addition, regenerative turbine pumps typically cost less and generate less audible noise during operation.

As fuel pumps get smaller and smaller to achieve higher pressures, the housing that contains the pumps have tighter tolerances. To achieve these tolerances, the current housings are made of anodized aluminum. Anodized aluminum works well in pure gasoline systems, but has a tendency to corrode when gasoline is mixed with flex fuels or other aggressive fuels such as methanol/gasoline or ethanol/gasoline mixtures.

Various solutions have been attempted to replace anodized aluminum in fuel pump housing. One solution is to coat the anodized aluminum, however this is very costly. Another possible solution uses a thermoplastic or thermosetting material to replace the anodized aluminum housing designs. However, conventional housing using thermoplastic or thermosetting materials typically experience one of two problems. First, thermoplastic or thermosetting housings having narrow seal surfaces between the cover and the housing cannot be used in high-pressure applications (greater than 100 kpa) because their narrow seal surfaces tend to creep. Second, where the seal surface width is increased to combat creep and allow the housings to be used in higher pressure (300–500 kpa) applications, the friction generated between the housing and the impeller increases.

SUMMARY OF THE INVENTION

It is therefore an object of the present invention to introduce a new pump housing to replace anodized aluminum housings in regenerative fuel pumps. The present invention overcomes the present obstacles by introducing a non-corrosive, lower cost pump housing made of thermoplastic or thermoset materials that can be used in higher pressure (300–500 kpa) applications. The present invention reduces leakage associated with creep compared to other thermoplastic or thermoset housings by introducing new designs for the cover and the body of the housing that have a double sealing surface. The present invention also eliminates corrosion of the housing due to flex fuel or other aggressive fuel systems as compared with conventional anodized aluminum housings. In addition, the present invention limits friction as compared with other thermoset or thermoplastic conventional housings used in higher-pressure applications.

A preferred embodiment of the improved fuel pump for use in high-pressure applications with aggressive or flex fuels consists of a non-corrosive pump housing having a pump cover and pump body, a motor mounted within the pump housing having a shaft, and an impeller located between the pump cover and pump body connected to the shaft for rotatably pumping fuel. The pump body and pump cover are each comprised of a narrow seal ring, a cavity core, and a tapered seal ring extending radially between the narrow seal ring and the cavity core.

The narrow seal rings prevent appreciable leakage between the pump cover or pump body and the impeller. Further, the tapered seal ring provides a secondary protection against leakage should the narrow seal rings creep slightly.

The narrowness of the narrow seal rings, preferably around 1–3 millimeters wide (substantially less than presently available non-corrosive pump covers and pump bodies used in high pressure applications, which are typically around 8 millimeters in width), decreases the friction between the pump housing and the impeller, which increases turn increases the efficiency pumping action.

The increased taper ratios (3–5 times greater than typical anodized aluminum designs) along the tapered seal ring results in a decrease in friction between the pump cover and impeller and the pump body and impeller, respectively, as compared with anodized aluminum housings.

Further, the new design of the narrow seal ring in the pump covers and pump bodies does not creep appreciably, and thus can be used in higher-pressure applications (300–500 kpa) that are standard for present-day automotive fuel pump systems.

Other objects and advantages of the present invention will become apparent upon considering the following detailed description and appended claims, and upon reference to the accompanying drawings.

DESCRIPTION OF THE PREFERRED EMBODIMENT(S)

Figure 1:
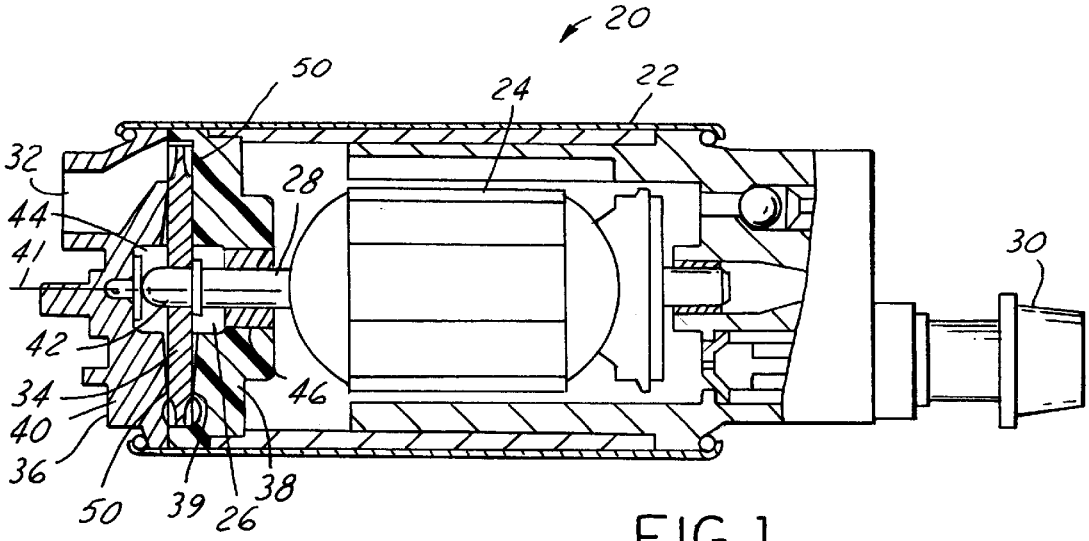
FIG. 1 is a cross-sectional view of a fuel pump according to a preferred embodiment of the present invention.

Referring now to FIG. 1, fuel pump 20 has a housing 22 for containing a motor 24, preferably an electric motor, which is mounted within a motor space 26. The motor 24 has a shaft 28 extending therefrom in a direction from a fuel pump outlet 30 to a fuel inlet 32. A disk-shaped impeller 34 is slidingly engaged onto the shaft 28 and is encased within a pump housing 36, which is comprised of a pump body 38 and a pump cover 40. The impeller 34 has a central axis 41 that is coincident with the axis of the shaft 28. The shaft 28 passes through a shaft opening 42 of the impeller 34 and into a cover recess 44 of the pump cover 40. As seen in FIG. 1, the shaft 28 is journalled within a bearing 46. The pump body 38 has a flow channel 39 leading from a pumping chamber 50 formed along the periphery of the impeller 34.

In operation, fuel is drawn from the fuel tank (not shown), in which a fuel pump 20 may be mounted, through the fuel inlet 32 and the pump cover 40 and into the pumping chamber 50 by the rotary pumping action of the impeller 34. High-pressure fuel is then discharged through the high-pressure outlet (shown as 190 in FIG. 5) to the motor space 26 and cools the motor 24 while passing it to the fuel pump outlet 30.

Figure 2:
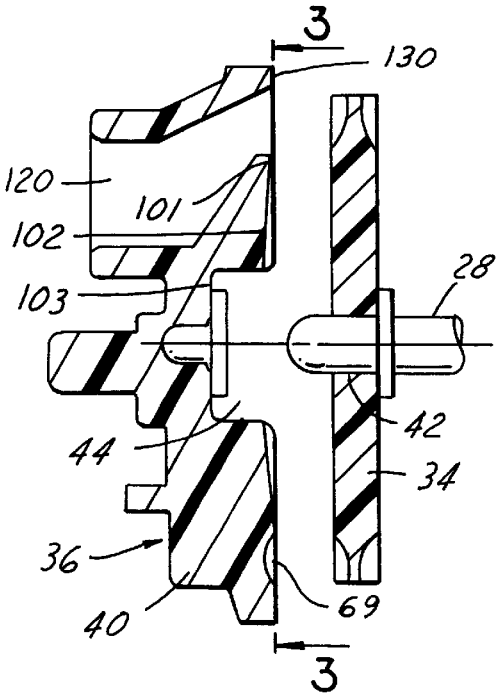
FIG. 2 is a cross-sectional view of the cover and impeller according to a preferred embodiment of the present invention.
Figure 3:
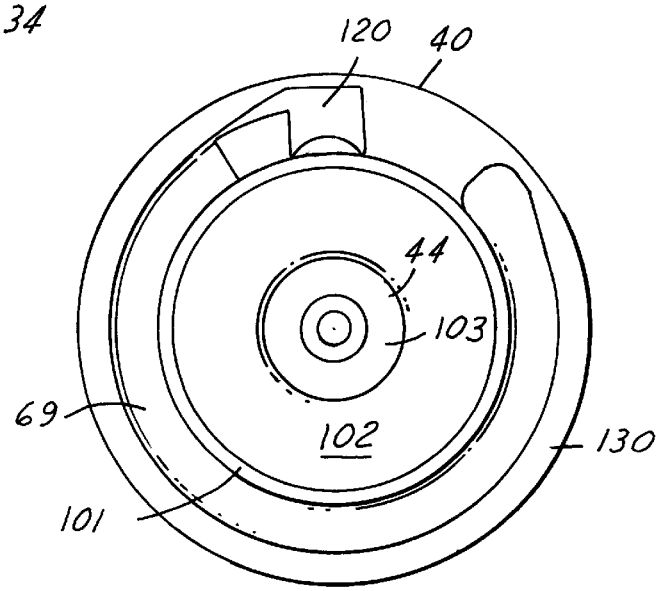
FIG. 3 is a cross-sectioned view of FIG. 2 along the section line 3—3.

Turning now to FIGS. 2 and 3, the pump cover 40 and the impeller 34 are shown according to a preferred embodiment of the present invention. Pump cover 40 comprises three redesigned elements: a narrow seal ring 101; a cavity circle 103; and a tapered seal ring 102 formed between the narrow seal ring 101 and the cavity circle 103. A flow channel 69 is located between the narrow seal ring 101 and the outer seal 130. The tapered seal ring 102 extends radially towards the center axis of the pump cover 40. The pump cover 40 also contains an outer seal 130 that couples with an outer seal 140 of the pump body 38 (shown in FIGS. 4 and 5) to fully contain the impeller 34 and to prevent leakage. A low-pressure fuel inlet 120 is located between the outer seal 130 and the narrow seal ring 101, where fuel (not shown) is drawn into the vanes (not shown) of the impeller 34 from the fuel tank (not shown).

The narrow seal ring 101 is preferably approximately 1–3 millimeters wide (substantially less than any thermoplastic or thermoset pump cover seal rings used in high-pressure applications, which are typically around 8 millimeters) and functions to prevent leakage of fuel between the impeller 34 and the pump cover 40. The tapered seal ring 102 is preferably approximately 8–10 millimeters wide and has a taper ratio of 15–25/10,000, which is three to five times higher than an aluminum housing tapered surface. The tapered seal ring 102 secondarily aids in preventing leakage between the pump cover 40 and the impeller 34, as the distance between the tapered seal ring 102 at its furthest point from the impeller 34 is approximately 0.02 millimeters wider than at its narrowest point.

The narrowness of the narrow seal ring 101 and the increased taper ratio of the tapered seal ring 102 aid in limiting friction between the impeller 34 and the pump cover 40. This friction can adversely affect pumping efficiency and reduce electric motor 24 life due to increased current draw. The cavity circle 103 is a recessed area of the pump cover 40 that may contain a pump bottom (not shown) and a portion of the shaft 28 cooperating with the impeller 34.

Figure 4:
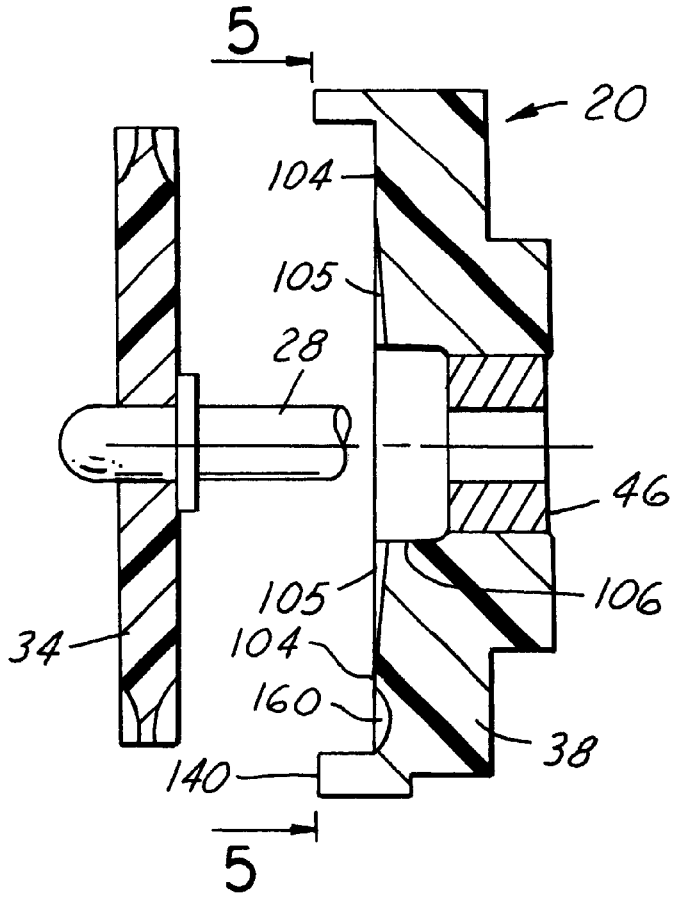
FIG. 4 is a cross-sectional view of the impeller and body according to a preferred embodiment of the present invention.
Figure 5:
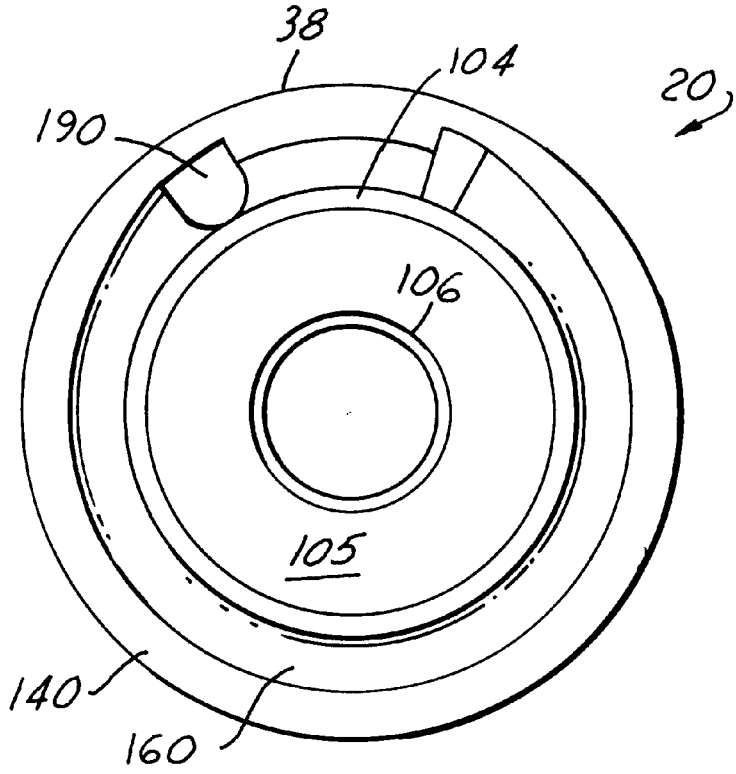
FIG. 5 is a cross-sectioned view of FIG. 4 along the section line 5—5.

Turning now to FIGS. 4 and 5, the pump body 38 and the impeller 34 are shown according to a preferred embodiment of the present invention. The pump body 38 has essentially the same design as the pump cover 40. The pump body 38 comprises three redesigned elements: a narrow seal ring 104; a cavity circle 106; and a tapered seal ring 105 formed between the narrow seal ring 104 and the cavity circle 106. The tapered seal ring 105 is tapered and extends radially towards the center axis of the pump body 38. The pump body 38 also contains an outer seal 140 that couples with the outer seal 130 of the pump cover 40 to fully contain the impeller 34 and to prevent leakage. Between the outer seal 140 and the narrow seal ring 104 is the flow channel 160.

The narrow seal ring 104 is preferably approximately 1–3 millimeters wide (substantially less than any thermoplastic or thermoset pump body seal rings used in high-pressure applications, which are typically around 8 millimeters) and functions to prevent leakage of fuel between the impeller 34 and the pump body 38. The tapered seal ring 105 is preferably approximately 8–10 millimeters wide and has a taper ratio of 15–25/10,000, which is three to five times higher than an aluminum housing tapered surface. The tapered seal ring 105 secondarily aids in preventing leakage between the pump body 38 and the impeller 34, as the distance between the tapered seal ring 105 at its furthest point from the impeller 34 is approximately 0.02 millimeters wider than at its narrowest point.

The narrowness of the narrow seal ring 104 and the increased taper ratio of the tapered seal ring 105 aid in limiting friction between the impeller 34 and the pump body 38. This friction can adversely affect pumping efficiency and reduces electric motor 24 life due to increased current draw. The pump body 38 also contains an outer seal 140 that couples with the outer seal 130 of the pump cover 40 to fully contain the impeller 34 and to prevent leakage. The cavity circle 106 is a recessed area of the pump body 38 that contains the bearing 46 and a portion of the shaft 28 cooperating with the impeller 34.

In operation, fuel enters the vanes of the impeller 34 at the low-pressure fuel inlet 120 of the pump cover 40, flows through the parallel flow channels 69, 160, and exits the impeller 34 through the high-pressure fuel outlet 190 of the pump body 38 into the motor space 24 as is well known in the art.

The preferred embodiment of the pump housing 36 design has other advantages as well. First, the pump housing 36 allows for the use of thermoplastic materials, such as polypropylene sulfide (PPS), or thermoset materials, such as phenolic polymers, to replace the anodized aluminum typically used in pump housings 36. Thermoplastic or thermoset materials decrease the cost of the pump housings 36, as plastics are cheaper than anodized aluminum housings (material cost and manufacturing costs) and much cheaper than polymer coated pump housings. Further, because plastic pump housings 36 are non-corrosive, more aggressive fuels or flex fuels may be used in addition to pure gasoline systems.

Second, the new design allows the plastic pump housings 36 to be used in higher-pressure systems (300–500 kpa) as compared with typical plastic pump housings, which may only be used in low-pressure applications (100 kpa or less) due to creepage of the seals. The increased taper in the taper seal ring decreased the amount of friction present between the impeller 34 and the pump housing 36 to allow the impeller 34 to freely rotate between the pump cover 40 and pump body 38.

While the invention has been described in terms of preferred embodiments, it will be understood, of course, that the invention is not limited thereto since modifications may be made by those skilled in the art, particularly in light of the foregoing teachings.

What is claimed is:

1. A fuel pump comprising:

a non-corrosive fuel pump housing having a pump cover and a pump body;

a motor mounted within said non-corrosive fuel pump housing having a shaft extending therefrom;

an impeller located between said pump cover and said pump body and attached to said shaft for rotatably pumping fuel; and said pump cover having a narrow seal ring, a cavity core, and a tapered seal ring between said narrow seal ring and said cavity core, for preventing fuel leakage between said pump cover and said impeller, wherein said tapered seal ring cooperates with a second portion of said impeller and is tapered inward radially towards said cavity circle, where said tapered seal ring has a taper ratio of 15–25/10,000 and is approximately 8–10 millimeters in width.

2. A fuel pump as in claim 1, wherein said non-corrosive fuel pump housing is comprised from a group consisting of a thermoplastic material and a thermosetting material.

3. A fuel pump as in claim 1, wherein said narrow seal ring cooperates with a portion of said impeller and is 1–3 millimeters wide.

4. A fuel pump as in claim 1, wherein said pump body having a second narrow seal ring, a second cavity core, and a second tapered seal ring located between said second narrow seal ring and said second cavity core, for preventing fuel leakage between said pump body and said impeller.

5. A fuel pump as in claim 4, wherein said second narrow seal ring cooperates with a third portion of said impeller and is 1–3 millimeters wide.

6. A fuel pump as in claim 4, wherein said second tapered seal ring cooperates with a fourth portion of said impeller and is tapered inward radially towards said second cavity circle, where said second tapered seal ring has a taper ratio of 15–25/10,000 and is approximately 8–10 millimeters in width.

7. A fuel pump comprising:

a non-corrosive fuel pump housing having a pump cover and a pump body;

a motor mounted within said non-corrosive fuel pump housing having a shaft extending therefrom;

an impeller located between said pump cover and said pump body and attached to said shaft for rotatably pumping fuel; and said pump body having a second narrow seal ring, a second cavity core, and a second tapered seal ring located between said second narrow seal ring and said second cavity core, for preventing fuel leakage between said pump body and said impeller, wherein said second tapered seal ring cooperates with a second portion of said impeller is tapered inward radially towards said second cavity circle, where said second tapered seal ring has a taper ratio of 15–25/10,000 and is approximately 8–10 millimeters in width.

8. A fuel pump as in claim 7, wherein said non-corrosive fuel pump housing is comprised from a group consisting of a thermoplastic material and a thermosetting material.

9. A fuel pump as in claim 7, wherein said second narrow seal ring cooperates with a portion of said impeller and is 1–3 millimeters wide.

10. A fuel pump as in claim 7, wherein said pump cover having a narrow seal ring, a cavity core, and a tapered seal ring between said narrow seal ring and said cavity core, for preventing fuel leakage between said pump cover and said impeller.

11. A fuel pump as in claim 10, wherein said narrow seal ring cooperates with a third portion of said impeller and is 1–3 millimeters wide.

12. A fuel pump as in claim 10, wherein said tapered seal ring cooperates with a fourth portion of said impeller and is tapered inward radially towards said cavity circle, where said tapered seal ring has a taper ratio of 15–25/10,000 and is approximately 8–10 millimeters in width.

13. A fuel pump comprising:

a non-corrosive fuel pump housing having a pump cover and a pump body;

a motor mounted within said non-corrosive fuel pump housing having a shaft extending therefrom;

an impeller located between said pump cover and said pump body and attached to said shaft for rotatably pumping fuel;

said pump cover having a narrow seal ring, a cavity core, and a tapered seal ring between said narrow seal ring and said cavity core, for preventing fuel leakage between said pump cover and said impeller; and said pump body having a second narrow seal ring, a second cavity core, and a second tapered seal ring located between said second narrow seal ring and said second cavity core, for preventing fuel leakage between said pump body and said impeller, wherein said tapered seal ring cooperates with a second portion of said impeller and is tapered inward radially towards said cavity circle, where said tapered seal ring has a taper ratio of 15–25/10,000 and is approximately 8–10 millimeters in width.

14. A fuel pump as in claim 13, wherein said non-corrosive fuel pump housing is comprised from a group consisting of a thermoplastic material and a thermosetting material.

15. A fuel pump as in claim 13, wherein said narrow seal ring cooperates with a portion of said impeller and is 1–3 millimeters wide.

16. A fuel pump as in claim 13, wherein said second narrow seal ring cooperates with a third portion of said impeller and is 1–3 millimeters wide.

17. A fuel pump as in claim 13, wherein said second tapered seal ring cooperates with a fourth portion of said impeller and is tapered inward radially towards said second cavity circle, where said second tapered seal ring has a taper ratio of 15–25/10,000 and is approximately 8–10 millimeters in width.

* * * * *